United States Patent [19]

Rees

[11] 4,428,329

[45] Jan. 31, 1984

[54] STEAM GENERATOR SUPPORT STRUCTURE

[75] Inventor: Karl Rees, Ruti, Switzerland

[73] Assignee: Sulzer Brothers Ltd., Winterthur, Switzerland

[21] Appl. No.: 408,927

[22] Filed: Aug. 17, 1982

[30] Foreign Application Priority Data

Sep. 9, 1981 [CH] Switzerland ..... 5812/81

[51] Int. Cl.[3] ..... F22B 37/24

[52] U.S. Cl. ..... 122/510; 122/6 A; 122/235 A

[58] Field of Search ..... 122/510, 511, 512, 6 A, 122/235 A

[56] References Cited

U.S. PATENT DOCUMENTS

| | | | |
|---|---|---|---|
| 1,922,599 | 8/1933 | Murray | 122/510 |
| 3,135,243 | 6/1964 | Schroedter | 122/6 A |
| 3,263,672 | 8/1966 | Oechslin et al. | 122/510 |
| 3,280,799 | 10/1966 | Schroedter | 122/6 A |
| 3,607,130 | 9/1971 | Worley | 122/511 |
| 3,760,744 | 9/1973 | Michel | 122/6 A |
| 3,814,063 | 6/1974 | Bijmholt | 122/6 A |
| 4,246,872 | 1/1981 | Skinner et al. | 122/512 |
| 4,347,810 | 9/1982 | Rees | 122/512 |

FOREIGN PATENT DOCUMENTS

| | | | |
|---|---|---|---|
| 576488 | 10/1977 | U.S.S.R. | 122/510 |

*Primary Examiner*—Henry C. Yuen
*Attorney, Agent, or Firm*—Kenyon & Kenyon

[57] ABSTRACT

The steam generator is comprised of a pair of vertical flues which are connected by a transverse flue. The support structure uses bearing systems to suspend the vertical flues in a region immediately below the transverse flue. The bearing systems are also mounted on a support structure immediately below the transverse flue.

The support arrangement eliminates the need for any bearer tubes passing from the back wall of the first vertical flue and the front wall of the second vertical flue through the transverse flue.

11 Claims, 4 Drawing Figures

STEAM GENERATOR SUPPORT STRUCTURE

This invention relates to a steam generator support structure.

As is known, steam generators have been constructed with a pair of vertical flues which are interconnected by a short transverse flue at the upper ends. Generally, the first vertical flue is made from tubes which are secured together, as by welding, in seal-tight relation to form tube banks which enclose a combustion chamber. In addition, the two vertical flues are usually suspended from a support structure by means of tension members which extend from a top edge of the tube banks. Further, the back wall of the first vertical flue and the front wall of the second vertical flue have been suspended via tubes which form continuations of the two walls. Usually, these tubes have been spaced where they are taken through the transverse flue. For this spacing, most of the tubes coming out of the wall are bent and just a few of the tubes extend straight through the transverse flue.

In large steam generators having tall and heavy tube banks, a problem is that the straight-through tubes must be reinforced in order to be able to take the load component of the bent tubes which cannot be subjected to loading. However, reinforced tubes of this kind are thermally more inert than the tubes in the side walls. Further, these tubes are partially screened by the bent tubes so that, although they are subjected to the flow of flue gases, when the flue gas temperature changes, they react more inertly than the tube portions of the adjacent side walls which are at the same height. This may result in inadmissible high stresses, particularly in a region of the bottom corners of the transverse flue.

Accordingly, it is an object of the invention to eliminate inadmissible high stresses in a steam generator having pairs of vertical flues suspended within a support structure.

It is another object of the invention to provide a relatively simple support structure for supporting a steam generator having a pair of vertical flues connected by a transverse flue.

Briefly, the invention is directed to a support for a steam generator including a first vertical flue having a plurality of tube banks defining a combustion chamber, a second vertical flue and a transverse flue connecting the vertical flues with each other at the upper ends. The support includes a support structure, for example of skeletal construction, and a pair of bearing systems which are mounted on the support structure for supporting the respective vertical flues.

In accordance with the invention, each bearing system is mounted on the support structure below the transverse flue to support a respective vertical flue in a region immediately below the transverse flue.

The construction of each bearing system is such that bearer tubes which might otherwise extend through the transverse flue are eliminated. In addition, the part of the support structure which is situated above the bearing system can be made lighter in weight. Further, the tubes in the top part of the two vertical flues are subjected to less stress and the assembly of the steam generator can be carried out relatively quickly since nests of heating surfaces can be installed after the combustion chamber has been completed. Still further, shifting of the vertical flues at the bottom ends due to thermal expansion is also reduced.

Each bearing system includes a plurality of two-armed levers, each of which is connected at one end to a respective tube bank. In addition, each lever is connected via a suspension link and a tension element to a horizontally disposed arm of the support structure in a manner which permits relative movement between the tube banks and the arms of the support structure.

Each bearing system may also include a cradle which is braced against the support structure in a horizontal plane and disposed about a respective vertical flue. In this way, the bearing systems can follow the thermal expansion of the tube banks without there being any appreciable horizontal forces.

In accordance with the invention, each suspension link and/or each tension element is resilient in a longitudinal direction. This has the advantage of uniform wall loading because the inevitable dimensional differences and adjustment errors have a less marked effect. For example, each suspension link may be constructed with a resilient spring. In this case, at least one hydraulic press may be used for tensioning a respective spring during an adjustment in length of a suspension link or tension element.

The length of the suspension links and/or the tension elements may also be adjustable to compensate for any manufacturing and assembly errors.

In order to effect a uniform introduction of bracing forces into the tube banks, thus eliminating inadmissible high local stresses, each two-armed lever is connected to a tube bank via a plurality of vertical strips which are secured to the tube bank and a tongue which is secured between and to the strips and a respective lever.

These and other objects and advantages of the invention will become more apparent from the following detailed description taken in conjunction with the accompanying drawings wherein:

FIG. 1 diagrammatically illustrates a side elevation of a steam generator supported in accordance with the invention;

Figure 2:
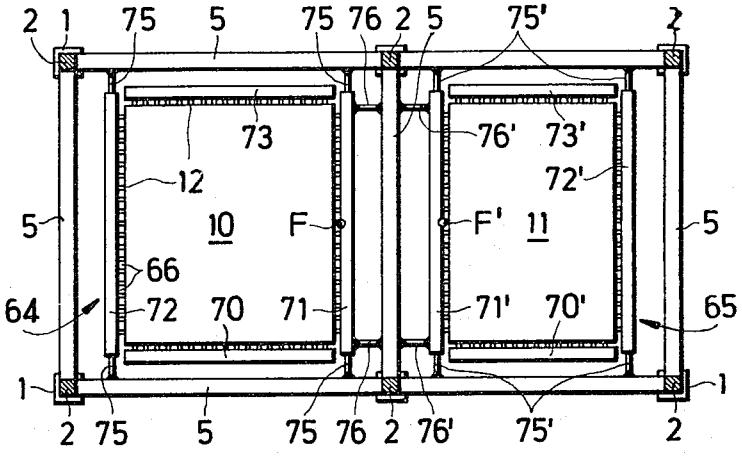
FIG. 2 illustrates a diagrammatic sectional view taken on line II—II of FIG. 1.
Figure 1:
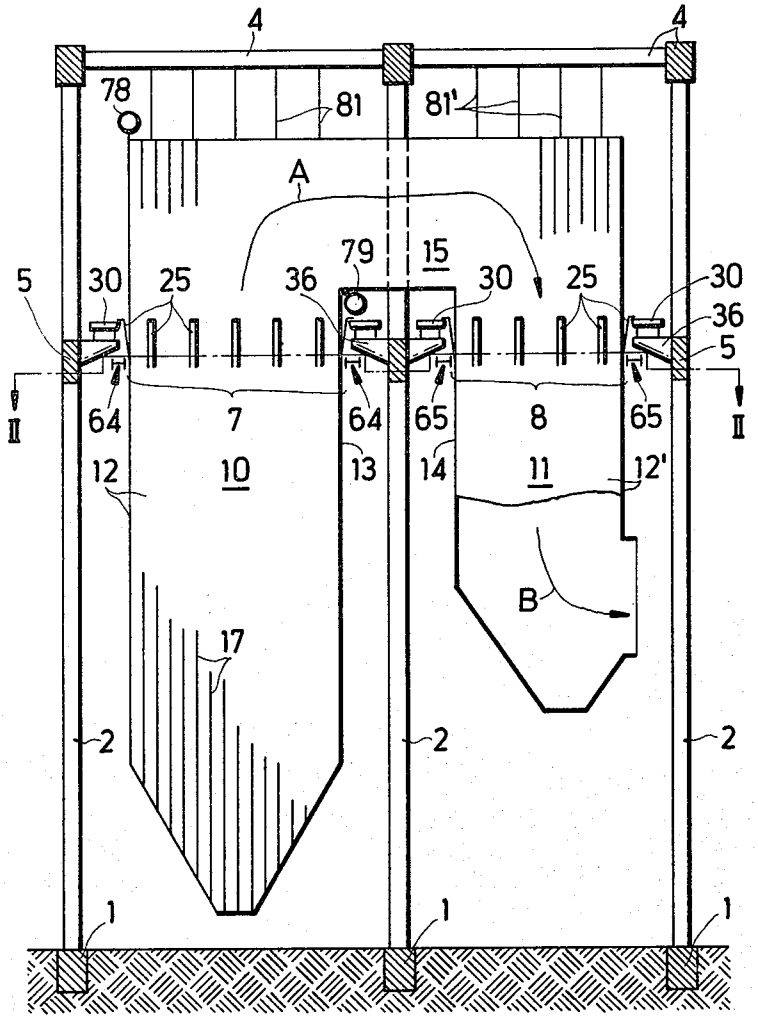

Referring to FIGS. 1 and 2, the support structure has six vertical columns 2 which are erected on foundations 1, a top frame 4 and a bottom frame 5 in the form of a stylized figure eight.

The steam generator which is supported in the support structure includes a pair of vertical flues 10, 11 and a transverse flue 15 which connects the vertical flues 10, 11 together at the upper ends thereof. The first vertical flue 10 has a plurality of vertical tubes 17 which are secured to each other, for example by welding, in seal-tight relation via webs 20 (see FIG. 3) to form four tube banks 12, 13. The lower ends of the tube banks 12, 13 define a steam generator combustion chamber in which flue gases are generated.

The second vertical flue 11 is constructed in similar manner to the first with four tube banks 12', 14. The two vertical flues 10, 11 are connected by the transverse flue 15 such that the flue gases flow successively as indicated by the arrows A, B. As indicated, the transverse flue 15 leads from the back wall 13 of the first flue 10 to the front wall 14 of the second flue 11.

In order to mount the flues 10, 11 on the support structure, bearing systems 7, 8 are provided in a region immediately below the transverse flue 15. As indicated in FIG. 1, the bearing systems 7, 8 are secured to the bottom frame 5 and the tube banks 12, 13; 12', 14 are suspended from the respective bearing systems 7, 8.

Figure 3:
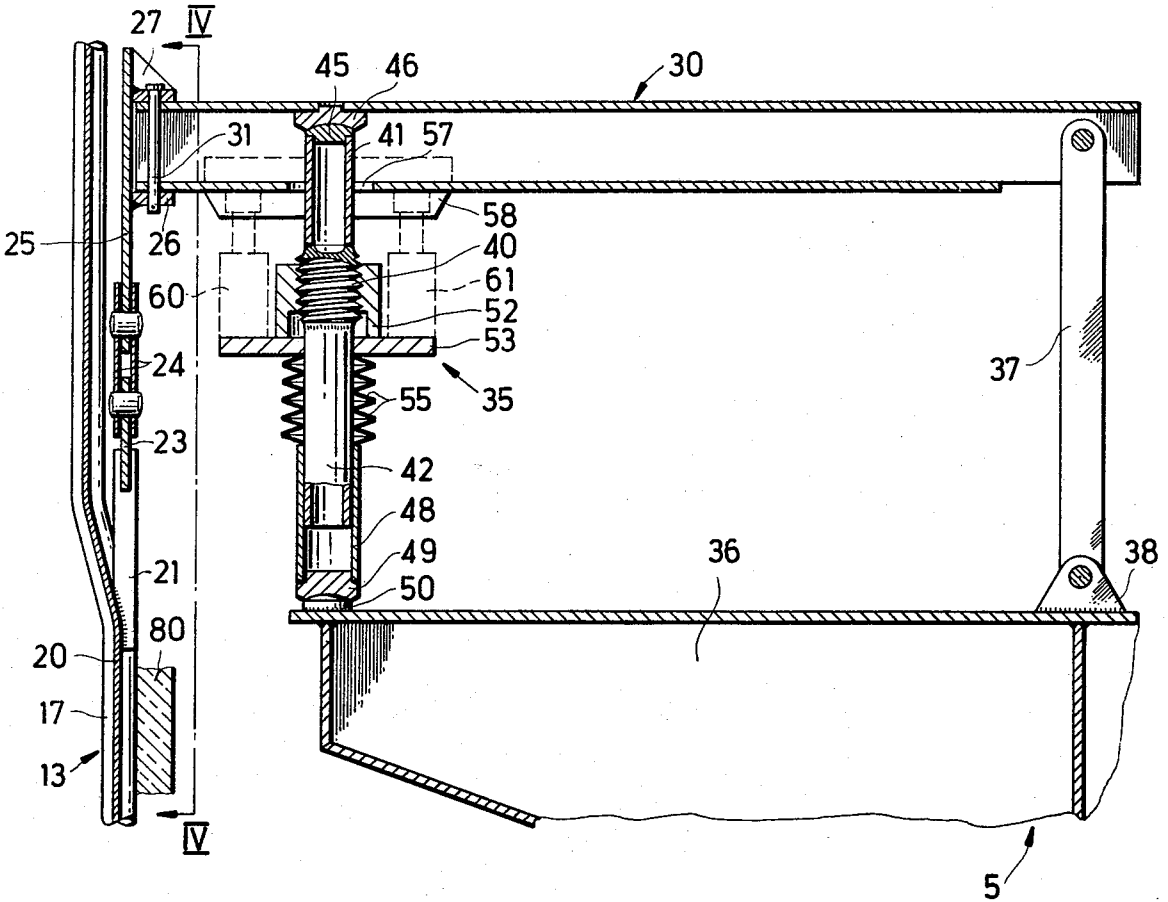
FIG. 3 illustrates a longitudinal sectional view through a two-armed lever with a corresponding suspension link and tension element in accordance with the invention.

Referring to FIG. 3, the bottom frame 5 of the support structure includes a plurality of horizontally disposed cantilevered arms 36 (only one of which is shown for clarity). These arms 36 serve to support the bearing systems 7, 8, respectively and, in turn, the steam generator.

Figure 4:
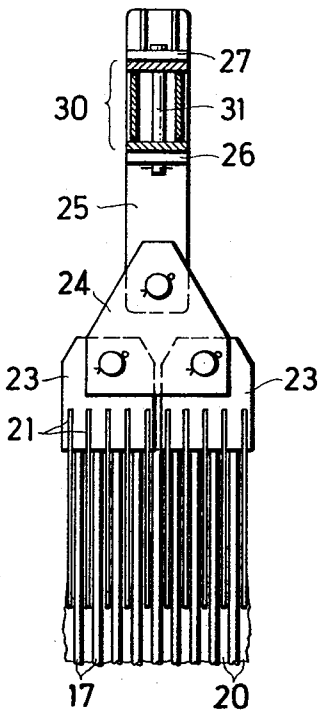
FIG. 4 illustrates a view taken on line IV—IV of FIG. 3.

The suspension of each tube bank is similar. Hence, the suspension of only one tube bank 13 will be further described. In this regard, as indicated in FIGS. 3 and 4, each bearing system includes a plurality of vertical sheet metal strips 21 which are secured, as by welding, to the webs 20 of the tube bank 13 in the region of the bottom frame 5. These strips 21 are secured in groups in the style of a comb on connecting plates 23. Each pair of these connecting plates 23 is, in turn, pivotally connected to and between a pair of tongues 24 each of which is formed with three bore holes and which is pivotally connected to a link 25.

The bearing system 7, 8 are each provided with a plurality of two-armed levers 30 (only one of which is shown in FIG. 3). These levers 30 are located above the cantilevered arms 36 of the support structure and each is connected at one end to a tube bank via a link 25. To this end, each link 25 has two claws 26, 27 between which projects one end of a lever 30. As indicated in FIG. 4, each lever 30 is constructed as a box girder and has a vertical pin 31 fitted through the end and through the claws 26, 27. The lever 30 is thus pivotable about the vertical axis of the pin 31.

In addition, each lever 30 bears via a suspension link 35 on the arm 36 while a tension element 37 connects the other end of the lever 30 to a bracket 38 on the arm 36. As shown in FIG. 3, the bracket 38 is centered between the arm 36 and the remainder of the bottom frame 5.

Each suspension link 35 is resilient in a longitudinal direction and is adjustable in length. To this end, each suspension link consists of a short screw bolt 40 to which tubular members 41, 42 are welded at the top and bottom. The top end of the tubular member 41 is provided with a part-spherical member 45 on which a cup 46 which is secured to a top flange of the lever 30 is fitted. The bottom tubular member 42 fits telescopically into a tubular member 48 which is connected to a cup 49 at the lower end. This cup 49, in turn, rests on a part-spherical member 50 secured, as by welding, to the arm 36. In addition, a nut 52 which is recessed at one end fits on the bolt 40 and bears, via a plate 53, on a set of cup springs 55, the lower one of which bears against the top end of the tubular member 48. The bottom flange of the lever 30 is formed with a recess 57 through which the suspension link 35 extends with a clearance. Each lever 30 is reinforced in the region of the recess 57 by two plates 58 which, on the outside, are welded to the webs of the lever 30. In addition, a pair of small hydraulic presses 60, 61 are disposed between the plate 53 and the bottom flange of the lever 30 for purposes as described below.

Referring to FIGS. 1 and 2, a cradle 64, 65, respectively, is provided just below the arms 36 at each of the vertical flues 10, 11. As indicated in FIG. 2, one cradle 64 consists of four flexural members 70–73 which surround the flue 10. The other cradle 65 consists of four flexural members 70'–73' which surround the flue 11. The flexural members are conventionally articulated at the ends, via straps, on the tube banks 12, 13; 12', 14 in a manner not shown and are connected to the associated tube bank by a plurality of supports 66 which are distributed over the length of the flexural members. Additional cradles which are constructed in the same way are also distributed over the entire height of the vertical flues 10, 11. These cradles serve to prevent the tube walls from bulging outwardly under internal pressures within the flues 10, 11. As indicated in FIG. 2, the cradles 64, 65 are braced against the support structure in a horizontal plane. For example, the flexural members 71, 72 of the cradle 64 extend transversely of the cross section of the steam generator and are braced against the frame 5 via supports 75 in order to prevent displacement in the transverse direction of the steam generator. The flexural member 71 is additionally connected via straps 76 to the middle member of the bottom frame 5. In like manner, the flexural members 71', 72' of the cradle 65 about the flue 11 are braced by supports 75' and straps 76' against the part of the bottom frame 5 surrounding this flue 11.

As indicated in FIG. 3, thermal insulation 80 may be provided on the outside of the tube banks 12, 13; 12', 14.

Referring to FIG. 1, the tubes 17 of the front wall 12 of the vertical flue 10 lead into a header 78 at the upper ends while the tubes 17 of the back wall 13 of the flue 10 lead to a header 79 which is parallel to the back wall 13 below the transverse flue 15.

The bearing system 7 for the vertical flue 11 is thus composed of the elements 21–38 and the cradle elements 70–76. Likewise, the bearing system 8 for the flue 11 is formed by the parts 21–38 and the cradle elements 70'–76'.

Of note, the plurality of two-armed levers 30 with the suspension links 35 and tension elements 37 are not stabilized to form the vertical flue bearing systems until the ends of the levers 30 are fixed horizontally. This is provided by the pins 31 and links 25 and, finally, by the supports 75, 75' and straps 76, 76' between the cradles 64, 65 and support structure.

In the bearing systems illustrated, the flexural members 71, 71' can move in space only vertically because of the supports 75, 75' and the straps 76, 76'. Further, the vertical displacement is very small because the cradles 64, 65 are disposed only just beneath the bearing systems 7, 8. Fixed points F, F' are thus obtained in the middle of each of the tube walls 13, 14 at the level of the support on the outer surface of the insulation 80. The thermal expansion movements thus radiate from these points. The transverse flue 15 is flexible in this arrangement so as to compensate for its own longitudinal expansion.

The suspension links 35 and the tension elements 37 are advantageously disposed on the bottom frame 5 so as to extend vertically in the case of an average expansion-caused deflection. In this way, the differences in level remain minimal when the steam generator is heated from a cold state. In order to keep the level differences small, the length of the suspension link and the length of the tension element are advantageously made about ten times the length of the maximum horizontal expansion occurring.

Since there may be considerable deviations in the dimensions vertically when the support structure and the steam generator are assembled, the suspension links 35 are made of adjustable length. In order to carry out an adjustment, the hydraulic presses 60, 61 are placed on the plate 53 on either side of the top tubular member 41 and pressure is applied until the total force exerted on the bottom of the lever 30 is equivalent to the load component required for the associated link 25 and corrected by the lever ratio. When this pressure has been adjusted, the nut 52 is threaded down against the plate 53 and moderately tightened. The two hydraulic presses 60, 61 can then be released and removed.

As indicated above, the laterally flexible support provided by the suspension links 35 and tension elements 37 requires that the links 25 should not be capable of moving laterally. This condition is satisfied by the lateral support of the cradles 64, 65 by the supports 75, 75' and straps 76, 76'. The other cradles (not shown) may also be supported in a similar manner on the support structure.

The weight of the transverse flue 15 can be transmitted by long cradles (not shown) which are reinforced to take gravity forces to the vertical flue wall portion situated above the bearing system 7, 8. Fixed suspension may also be provided whereby the transverse flue 15 is suspended from the top frame 4 of the support structure.

During assembly of the steam generator, the tube banks 12, 13; 12', 14 of the vertical flues 10, 11 are erected starting from the bearing system 7, 8 and progressing downwardly. Independently of the progress of this work, nests of heating surfaces (not shown) can be installed across the bearing system 7, 8 while burners are being fitted at the combustion chamber of the vertical flue 10. As indicated in FIG. 1, a plurality of bearer tubes 81, 81' of the nests of heating surfaces situated in a space above the combustion chamber of the vertical flue 10 and in the vertical flue 11, extends in gas tight relationship through the common roof of the flues 10, 15, 11 and are secured to the top frame 4 in known manner.

Consequently, the control system and lines to the burners can be fitted at a time when the transverse flue 15 and the top portions of the vertical flues 10, 11 are being assembled. A procedure of this kind allows considerable reduction in the assembly process. This can be critical in planning the timetable for construction.

In order to avoid making the transverse flue 15 resilient, the fixed point F' of the second flue 11 may be brought to the fixed point F of the first flue 10, for example by guiding the flexural members 71' by arms which are rigidly secured to the gas exit end of the transverse flue and projecting downwardly instead of using the straps 76'.

Of note, the walls forming the second vertical flue 11 may consist of tubes which are not welded together in gas-tight manner. Such a flue can then be erected in a skin-casing type of construction.

The invention thus provides a support for a steam generator having a pair of vertical flues, for example for use as a boiler, which permits a reduction in stresses within the generator. Further, by mounting the tube banks of the flues of the steam generator in a suspended fashion, the part of the support structure above the bearing systems can be made lighter in weight.

What is claimed is:

1. In combination, a steam generator having a pair of vertical flues and a transverse flue connecting said vertical flues together at upper ends thereof, each said vertical flue having a plurality of tubes secured together in seal-tight relation to form tube banks with a first vertical flue enclosing a combustion chamber;

a support structure for supporting said steam generator; and a bearing system mounted on said support structure below said transverse flue and supporting at least one vertical flue thereon in a region immediately below said transverse flue.

2. The combination as set forth in claim 1 wherein said support structure includes a plurality of horizontally disposed arms and said bearing system includes a plurality of two-armed levers, each said lever being connected at one end to a respective tube bank, a suspension link braced between a respective lever and a respective arm, and a tension element connected between each respective lever and a respective arm.

3. The combination as set forth in claim 2 wherein said bearing system further includes a cradle braced against said support structure in a horizontal plane and disposed about a respective vertical flue.

4. The combination as set forth in claim 2 wherein each suspension link and each tension element is resilient in a longitudinal direction thereof.

5. The combination as set forth in claim 2 wherein at least one of each suspension link and said tension element is adjustable in length.

6. The combination as set forth in claim 5 wherein each suspension link includes a resilient spring and wherein each bearing system includes a hydraulic press for tensioning a respective spring during an adjustment in length of one of a respective link and tension element.

7. The combination as set forth in claim 1 further comprising a plurality of vertical strips secured to a respective tube bank and a tongue secured between and to said strips and a respective bearing system.

8. The combination as set forth in claim 1 wherein the second of said vertical flues and said transverse flue have a plurality of tubes secured together in seat-tight relation.

9. In combination, a steam generator including a first vertical flue having a plurality of tube banks defining a combustion chamber, a second vertical flue and a transverse flue connecting said vertical flues with each other at upper ends thereof;

a support structure having a plurality of horizontally disposed arms; and a bearing system mounting at least said first flue on said arms of said support structure, said system including a plurality of two-armed levers, each said lever being connected at one end to a respective tube bank, a suspension link braced between a respective lever and a respective arm, and a tension element connected between each respective lever and a respective arm.

10. The combination as set forth in claim 9 wherein each suspension link is adjustable in length.

11. The combination as set forth in claim 9 wherein each suspension link is longitudinally resilient.

* * * * *